US005151630A

United States Patent [19]

Boy et al.

[11] Patent Number: 5,151,630

[45] Date of Patent: Sep. 29, 1992

[54] TRIGGERABLE SWITCHING SPARK GAP

[75] Inventors: Jürgen Boy; Matthias Jacubeit, both of Berlin, Fed. Rep. of Germany

[73] Assignee: Siemens Aktiengesellschaft, Berlin & Munich, Fed. Rep. of Germany

[21] Appl. No.: 606,150

[22] Filed: Oct. 31, 1990

[30] Foreign Application Priority Data

Nov. 2, 1989 [EP] European Pat. Off. ..... 89250072.9

[51] Int. Cl.[5] ..... H01J 17/30

[52] U.S. Cl. ..... 313/602; 313/603; 313/631; 313/637

[58] Field of Search ..... 313/602, 603, 631, 637

[56] References Cited

U.S. PATENT DOCUMENTS

| | | | |
|---|---|---|---|
| 3,230,410 | 1/1966 | Hafkemeyer, Jr. et al. | 313/602 X |
| 3,328,632 | 6/1967 | Robinson | 313/602 X |
| 3,715,614 | 2/1973 | Linkroum | 313/602 X |
| 3,725,729 | 4/1973 | McDermott et al. . | |
| 4,604,554 | 8/1986 | Wootton . | |
| 4,739,439 | 4/1988 | Boy | 313/609 X |
| 4,939,418 | 7/1990 | Wootton | 313/603 X |

FOREIGN PATENT DOCUMENTS 0242590 3/1987 European Pat. Off. .

2589015 4/1987 France .

OTHER PUBLICATIONS

Soviet Inventions Illustrated, Issued 18 Mar. 1981, Derwent London & SU-A-738022.

*Primary Examiner*—Donald J. Yusko
*Assistant Examiner*—Ashok Patel
*Attorney, Agent, or Firm*—Kenyon & Kenyon

[57] ABSTRACT

A triggerable switching spark gap has two main electrodes, which are insulated from each other, and a galvanically controllable trigger electrode, which is configured in the center of a circular opening of one main electrode. A clearance (a) between the two main electrodes is greater by the factor 1.1 to 2.3, preferably by the factor 1.4 to 1.7, than the width (b) of the ring gap between the trigger electrode and the corresponding main electrode. Furthermore, the circumferential edge of the trigger electrode (6) arranged to be flush with the discharge surface of the corresponding main electrode has a radius of curvature less than or equal to 0.1 mm and the trigger electrode and the corresponding main electrode are coated with a silver-containing activating mass. The delay time of the switching spark gap is able to be reduced to values less than or equal to 0.5 μs.

1 Claim, 1 Drawing Sheet

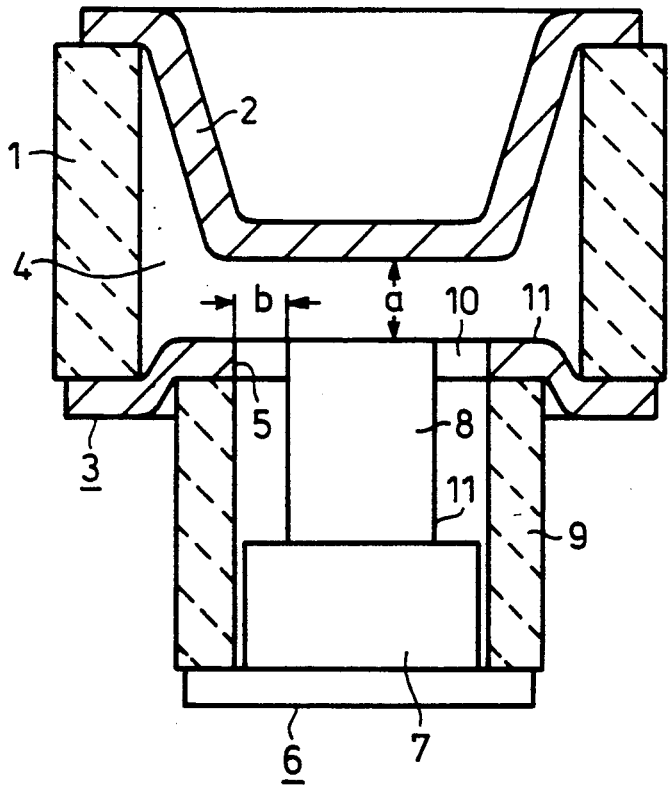
1
2
4
b
a
10
11
5
8
3
11
9
6
7

TRIGGERABLE SWITCHING SPARK GAP

BACKGROUND OF THE INVENTION

The present invention relates to electric components and is intended for application in the constructive development of a triggerable switching spark gap, in the case of which a galvanically triggerable electrode is configured concentrically inside an electrode of the main discharge gap. These types of components are used, inter alia, as controllable high-voltage switches in ignition devices. The high-voltage switch thereby transfers the energy stored in a capacitor quickly and with low-loss to a load, for example, to an ohmic resistor, which converts electrical energy into thermal energy, or to the primary winding of an ignition coil. This energy transfer must take place with low loss and quickly, that is, in particular, with a high rate of rise of the current and voltage pulses.

A known triggerable switching spark gap essentially comprises a gas-discharge space and a trigger electrode; the gas-discharge space is thereby defined by a cylindrical insulator, for example, a ceramic or glass tube, and by a first and a second main electrode, which are configured at the ends of the insulator and are connected in a vacuum-tight manner to this insulator. The main electrodes each have a flat discharge surface; the two discharge surfaces stand axially opposite each other. A cylindrical trigger electrode is arranged inside the first main electrode and is insulated from this electrode; thus this cylindrical trigger electrode is situated in the center of a circular opening of the first main electrode. The discharge surface of the trigger electrode is arranged to be flush with the discharge surface of the first main electrode; a cylindrical insulating body with which the trigger electrode is insulated from the first main electrode is arranged in the same way (see the brochure "EEV Spark Gaps" by the firm EEV).

If during the operation of such a known switching spark gap, a high-frequency, high-voltage pulse is applied to the trigger electrode, then the ignition of the discharge gap between the two main electrodes is introduced through a predischarge. The period of time from the ignition of the predischarge until the actual switching operation is defined as delay time or as ignition delay time. This amounts in the case of customary switching spark gaps to about 0.7 to 2 μs, at a voltage to be switched of 2 kV and at a natural breakdown voltage of about 3 kV. The gate-controlled rise time of the main discharge gap amounts to about 0.2 μs.

SUMMARY OF THE INVENTION

It is an object of the invention to provide a switching spark gap that will have a delay time of less than 0.5 μs. This is to apply particularly under the marginal conditions of a voltage to be switched of about 2 kV and of a natural breakdown voltage of about 5 kV.

The above and other objects of the invention are achieved by a triggerable switching spark gap, comprising a gas-discharge space defined by an insulator and by a first and a second main electrode (e.g. the cathode and anode, respectively), each having a flat discharge surface, and further comprising a cylindrical trigger electrode arranged inside the first main electrode, the first main electrode having a circular opening, the trigger electrode being arranged in the center of the opening flush with the discharge surface of the first main electrode and forming a ring gap therewith, a clearance between the discharge surfaces of the two main electrodes being greater by a factor 1.1 to 2.3 than a width of the ring gap between the trigger electrode and the first main electrode, a circumferential edge of the trigger electrode having a radius of curvature less than or equal to 0.1 mm, the trigger electrode and the first main electrode being coated with a silver-containing activating mass.

With this type of refinement for a switching spark gap, one attains an ignition delay time of about 0.01 to 0.5 μs and a gate-controlled rise time of about 0.01 μs. One is particularly able to attain this when the distance factor with respect to the clearance between the two main electrodes and the width of the ring gap lies between 1.25 and 2.0, optimally between 1.4 and 1.7. As an activating mass, one would particularly consider a silver layer or a melted layer of an eutectic silver-aluminum compound with an aluminum constituent of about 10 to 40% by weight.

In the operation of the new switching spark gap, one must ensure that the polarity of the trigger pulse is opposite the polarity of the voltage to be switched. In this case, high field intensities occur in the main discharge gap at the time of triggering which lead to the fast arcing-through of the main discharge gap.

BRIEF DESCRIPTION OF THE DRAWINGS

An exemplified embodiment of the invention is depicted in the single drawing figure.

DETAILED DESCRIPTION

The invention will be described in greater detail in the following detailed description with reference to the drawing, in which the main discharge gap of the new switching spark gap is formed by the first disk-shaped main electrode 3 (e.g. the cathode) and the second saucer-shaped main electrode 2 (e.g. the anode), which are inserted respectively in a vacuum-tight manner into one end of the tubular ceramic insulator 1. These three components form a discharge space 4, which is provided with a gas, in particular with pure nitrogen.

The disk-shaped main electrode 3 is provided with a ring-shaped opening 5, in whose center the trigger electrode 6 is arranged. This trigger electrode is comprised of a cylindrical base 7 and the actual, rod-shaped electrode part 8 and is connected in a vacuum-tight manner to the main electrode 3 with the interconnection of a tubular ceramic insulator 9. The circumferential edge of the rod-shaped electrode part 8 is sharply formed, that is, the radius of curvature is less than/equal to 0.1 mm. It is important that the end face of the control electrode 8 be flush with the discharge surface of the main electrode 3. The ring gap 10 resulting between the control electrode 8 and the ring-shaped opening 5 forms the predischarge gap.

The axial clearance between the discharge surfaces of the two main electrodes 2 and 3 is designated by a, the width of the ring gap between the trigger electrode 6 and the ring-shaped opening 5 of the main electrode 3 by b. The clearance a in the present case amounts to 1.1 mm±0.15 mm, the gap width b to 0.7 mm±0.15 mm.

Furthermore, the trigger electrode 6 and the disk-shaped main electrode 3 are coated, at least in the respective area which is important for the gas discharge, with an activating mass 11, which in the present case is silver. Expediently, the coating covers the entire surface of both electrodes.

The depicted switching spark gap features a minimal operating voltage of 1.3 kV and a natural breakdown voltage of about 5 kV; at an operating voltage of 2 kV and trigger pulse amplitudes of 2 to 4 kV, ignition delay times of 0.01 to 0.5 μs and gate-controlled rise times of about 10 ns were determined.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A triggerable switching spark gap for switching a voltage of approximately 2 kV, comprising:

a) a first main electrode having a flat discharge surface and a circular opening, said first main electrode being coated with an activating mass of silver or with a eutectic silver-aluminum compound constituent of approximately 10% to 40% by weight;

b) a second main electrode having a flat discharge surface;

c) an insulator disposed between the first main electrode and the second main electrode;

d) a gas-discharge space formed between the insulator, and the first and second main electrodes;

e) a cylindrical trigger electrode disposed inside the center of the circular opening and flush with the flat discharge surface of the first main electrode, forming a ring gap therebetween, having a circumferential edge with a radius of curvature less than or equal to 0.1 mm, and being coated with an activating mass of silver or with an eutectic silver-aluminum compound constituent of approximately 10% to 40% by weight, wherein a spacing between said first and second main electrodes is greater by a factor of 1.4 to 1.7 than a width of said ring gap.

* * * * *